US005316300A

United States Patent [19]

Simmons

[11] Patent Number: 5,316,300

[45] Date of Patent: May 31, 1994

[54] GOLF CLUB HAVING HOLLOW SHAFT WITH FLUID SELECTIVELY INSTALLED THEREIN

[75] Inventor: Samuel P. Simmons, Grass Valley, Calif.

[73] Assignee: Tourshot Golf Co., Inc., Grass Valley, Calif.

[21] Appl. No.: 22,130

[22] Filed: Feb. 25, 1993

Related U.S. Application Data

[63] Continuation-in-part of Ser. No. 814,495, Dec. 30, 1991, abandoned.

[51] Int. Cl.[5] ..... A63B 53/08; A63B 69/36

[52] U.S. Cl. ..... 273/80 R; 273/80 B; 273/170

[58] Field of Search ..... 273/167 R, 170, 171, 273/167 H, 77 R, 193 R, 194 R, 80 R–80 B, 73 R, 73 G, 73 J, 186.1, 186.2

[56] References Cited

U.S. PATENT DOCUMENTS

| | | | |
|---|---|---|---|
| 2,432,450 | 12/1947 | Sears . | |
| 3,083,969 | 4/1963 | Bills, Jr. . | |
| 3,516,673 | 6/1970 | Estes | 273/170 |
| 3,993,314 | 11/1976 | Harrington et al. | 273/170 |
| 4,541,631 | 9/1985 | Sasse | 273/170 |
| 4,715,606 | 12/1987 | Varley . | |
| 5,082,279 | 1/1992 | Hull . | |

*Primary Examiner*—Vincent Millin
*Assistant Examiner*—Sebastiano Passaniti
*Attorney, Agent, or Firm*—Edward A. Sokolski

[57] ABSTRACT

A column of high viscosity fluid is installed in a selected portion of the hollow shaft of a golf club. This fluid which does not flow readily reinforces the shaft and minimizes the bending and deformation thereof during the golf stroke. The location along the shaft at which the fluid column is installed is selectively chosen to provide an optimum natural vibration frequency for the shaft, a location closer to the club head providing a lower natural vibration frequency.

10 Claims, 1 Drawing Sheet

GOLF CLUB HAVING HOLLOW SHAFT WITH FLUID SELECTIVELY INSTALLED THEREIN

This application is a continuation in part of my U.S. application Ser. No. 07/814,495 Dec. 30, 1991.

FIELD OF THE INVENTION

This invention relates to a golf club and more particularly to a golf club having a hollow shaft in which a high viscosity fluid is selectively placed in a predetermined location to minimize deformation of the shaft under load and to control the natural vibration frequency of the shaft.

DESCRIPTION OF THE PRIOR ART

Fluid material, both liquid and non-liquid has been installed in both the shafts and heads of golf clubs in prior art devices, particularly with the objective of controlling the center of gravity of the club. Such prior art devices are described in U.S. Pat. No. 5,092,279 issued Jan. 21, 1992 to Hull, U.S. Pat. No. 2,432,450 issued Dec. 9, 1947 to Sears and U.S. Pat. No. 4,715,606 issued Dec. 29, 1987 to Varley. In all of these devices, the objective involved is to control the weighting and balance of the club.

Golf club shafts are generally made hollow in form to provide a high strength to weight ratio. Hollow club shafts tend to distort by bending or twisting during the golf stroke, particularly on impact with the ball. This results in a torquing action which can result in an error in the stroke. It has been found that by installing a relatively incompressible high viscosity fluid material in a selected portion of the shaft, this undesirable condition can be greatly ameliorated.

SUMMARY OF THE INVENTION

The device of the present invention is a golf club with hollow shaft having a column of fluid installed in a selected portion thereof. This fluid is of a high viscosity and is spaced from the opposite ends of the shaft a predetermined distance which spacing determines the natural vibration frequency of the shaft. The high viscosity fluid does not flow readily and gives the shaft a solid characteristic. The length of the fluid column encompassed 10–80% of the length of the shaft and in the preferred embodiment is 20–30% of the shaft length. When the shaft is swung distortion of its cross section in the area of the fluid is lessened substantially which minimizes bending or twisting of the shaft thereby increasing the accuracy of the stroke. In addition, the selective location of the fluid column along the length of the shaft can be used to raise or lower the natural resonant frequency thereof, as may be desired. This facilitates the design of various clubs having shafts with different dimensions and materials to all have the same natural vibration frequency which gives the golfer a similar feel to all of the clubs which he utilizes.

It is therefore an object of this invention to minimize inaccuracies in the stroke of a golf club due to distortion of the shaft on impact of the club with the ball;

It is a further object of this invention to provide a fluid column in a preselected location along a golf shaft to minimize distortion of the shaft;

Other objects of the invention will become apparent from the following description taken in connection with the accompanying drawings.

DETAILED DESCRIPTION OF THE INVENTION

Figure 1:
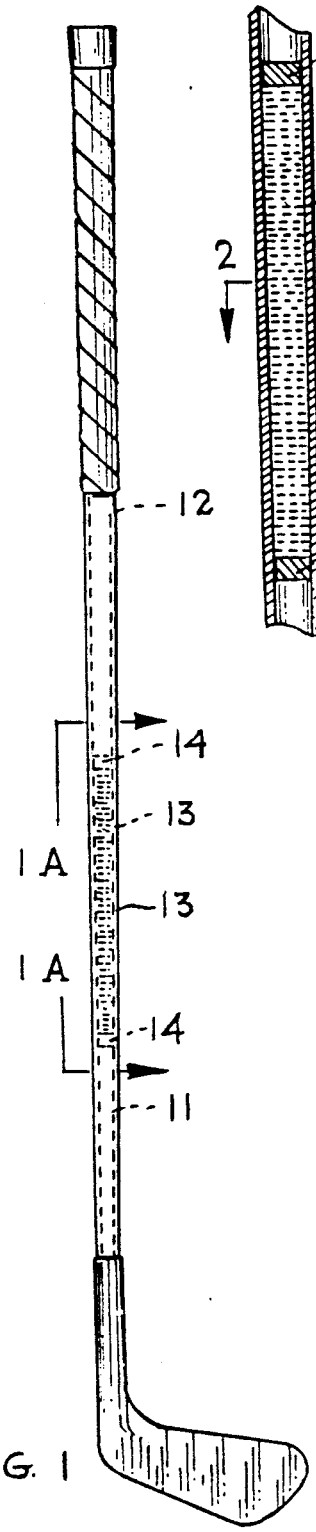
FIG. 1 is a side elevational view with of a preferred embodiment of the invention.
Figure 1A:
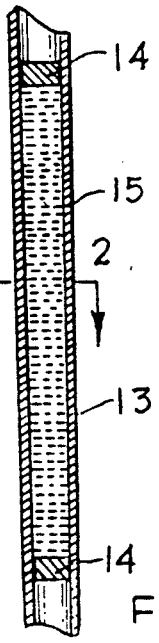
FIG. 1A is a cross sectional view taken along the plane indicated by 1A—1A in FIG. 1.
Figure 2:
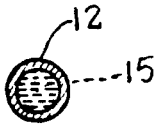
FIG. 2 is a cross sectional view taken along the plane indicated by 2—2 in FIG. 1A.

Referring now to FIGS. 1, 1A and 2, a preferred embodiment of the invention is illustrated. Golf club 11 has a hollow shaft 12. A chamber 13 is formed in the shaft by installing "dam" elements 14 therein, this chamber being filled with a fluid 15. Fluid, 15 is of a high viscosity, i.e. a viscosity of 250,000–350,000 centipoises at 5 rpm and 76 degs. F. This material should not flow readily and thus gives the shaft solidity. In the preferred embodiment latex calk type M8969 commercially available from Macklanburg-Duncan Co., Oklahoma City, OK is employed. Shaft 12 may be made of a metal or plastic material such as, for example, titanium, steel, graphite, boron, aluminum or Kevlar. The length of chamber 13 should constitute 10–80% of the total length of the shaft , a length which is 20–30% of the total shaft length being employed in the preferred embodiment.

The choice of such length is dictated by various considerations such as the flex pattern of the material and the characteristics of the fluid employed The positioning of chamber 13 along the length of the shaft affects the natural vibration frequency of the shaft, positioning closer to the club head making for a lower natural vibration frequency and vice versa. Thus, by selecting such positioning, the natural vibration frequency can be adjusted as may be desired. This facilitates the fabrication of clubs having shafts of different materials and dimensions all to have the same natural vibration frequency, as may be desired by any particular golfer.

Figure 3A:
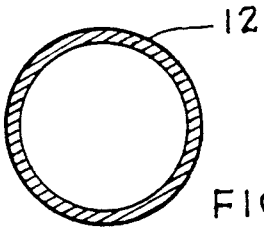
FIGS. 3A and 3B are cross sectional views showing the shafts of prior art clubs at rest and under stress.
Figure 3B:
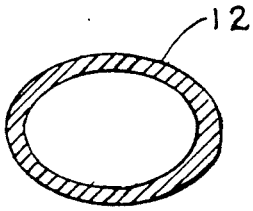
Figure 4A:
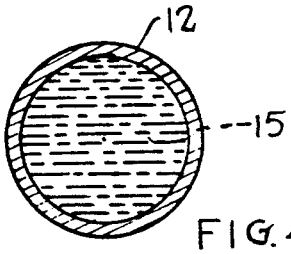
FIGS. 4A and 4B are cross sectional view showing the shafts of clubs of the invention at rest and under stress.
Figure 4B:
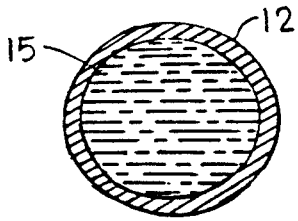

Referring now to FIGS. 3A and 3B, a cross sectional view of the shafts of typical prior art clubs are shown. In FIG. 3A, the shaft is shown in its static unloaded condition while in FIG. 3B, the shaft is shown under load at maximum deflection during the stroke. As can be seen, in FIG. 3B, the shaft distorts under load to an oval configuration. This, it has been found, results in twisting or torquing of the shaft contributing to an inaccurate stroke.

referring now to FIGS. 4A and 4B, a cross sectional view of the shaft of the device of the invention is shown in its static condition in FIG. 4A and under stress in FIG. 4B. As can be seen the shaft undergoes minimal distortion under stress, thus substantially lessening the torquing of the shaft during the stroke and making for more accurate stroking action.

The present invention thus provides a golf club having a more accurate stroking action and which can readily be designed for a desired natural vibration frequency.

While the invention has been described and illustrated in detail, it is to be clearly understood that this is intended by way of illustration and example only and is not to be taken by way of limitation, the scope of the invention being limited only by the terms of the following claims:

I claim:

1. In a golf club having a hollow shaft with an inner wall and opposite ends, the improvement comprising:

a pair of spaced dam elements installed along the inner wall of said shaft, said dam elements along with the inner wall of said shaft forming a fluid tight chamber, and a high viscosity fluid which does not flow readily installed in said chamber, wherein the fluid installed in said chamber has a viscosity of 250,000–350,000 centipoises at 5 rpm and 76 degrees Fahrenheit, said chamber being spaced from both of the ends of said shaft.

2. The golf club of claim 1 wherein the length of said chamber is 10–80% of the total length of said shaft.

3. The gold club of claim 1 wherein the length of said chamber is 20–30% of that of said shaft.

4. The gold club of claim 1 wherein said fluid is a latex calking material.

5. A method for modifying a hollow gold club shaft to minimize bending and twisting of said shaft during a gold stroke comprising the steps of:

providing a hollow gold club shaft having an inner wall and opposite ends forming a chamber in a predetermined portion of said shaft at a location spaced from the opposite ends thereof, and filling said chamber with a high viscosity fluid having a viscosity of 250,000–350,000 centipoises at 5 rpm and 76 degs F.

6. The method of claim 5 wherein the spacing of the chamber from the opposite ends of said shaft is selected to provide a desired natural vibration frequency of the shaft.

7. The method of claim 7 wherein the fluid placed in said chamber is a latex calking material.

8. The method of claim 1 wherein the length of said chamber is made to be 10–80% of the total length of said shaft.

9. The method of claim 5 wherein the length of said chamber is made to be 20–30% of the total length of said shaft.

10. The method of claim 5 wherein the chamber is formed by installing a pair of spaced dam elements along the inner wall of said shaft.

* * * * *

UNITED STATES PATENT AND TRADEMARK OFFICE

CERTIFICATE OF CORRECTION

PATENT NO. : 5,316,300

DATED : May 31, 1994

INVENTOR(S) : SAMUEL P. SIMMONS

It is certified that error appears in the above-indentified patent and that said Letters Patent is hereby corrected as shown below:

In claim 3, column 3, line 1, of the Patent, change "gold" to ---golf---.

In claim 4, column 3, line 1, of the Patent, change "gold" to ---golf---.

In claim 5, column 4, line 1, of the Patent, change "gold" to ---golf---.

In claim 5, column 4, line 3, of the Patent, change "gold" to ---golf---.

In claim 5, column 4, line 4, of the Patent, change "gold" to ---golf---.

Signed and Sealed this

Thirty-first Day of December, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,316,300
DATED : May 31, 1994
INVENTOR(S) : Sanuel P. Simmons

It is certified that error appears in the above-indentified patent and that said Letters Patent is hereby corrected as shown below:

In claim 7, column 4, line 1, of the Patent, change "7", second occurrence, to ---5---.

In claim 8, column 4, line 1, of the Patent, change "1" to ---5---.

Signed and Sealed this

Eleventh Day of February, 1997

Bruce Lehman

*Attest:*

BRUCE LEHMAN

*Attesting Officer*

*Commissioner of Patents and Trademarks*